US005292099A

United States Patent [19]

Isham et al.

[11] Patent Number: 5,292,099

[45] Date of Patent: * Mar. 8, 1994

[54] DISPLAY MOUNTED DOUMENT HOLDER

[75] Inventors: William R. Isham, American Fork, Utah; Dale A. Crowther, Burley, Id.

[73] Assignee: William R. Isham, American Fork, Utah

[ * ] Notice: The portion of the term of this patent subsequent to Jan. 21, 2009 has been disclaimed.

[21] Appl. No.: 841,831

[22] Filed: Feb. 26, 1992

[51] Int. Cl.[5] ..... B41J 11/00

[52] U.S. Cl. ..... 248/442.2; 248/447; 248/447.2; 248/231.4; 248/278; 248/918

[58] Field of Search ..... 248/442.2, 447, 452, 248/454, 460, 225.31, 918, 278, 231.4, 458, 285, 447.2; 16/317, 344

[56] References Cited

U.S. PATENT DOCUMENTS

| | | | |
|---|---|---|---|
| 297,284 | 4/1884 | Mudgett . | |
| D. 315,366 | 3/1991 | Greenspahn . | |
| 2,194,019 | 3/1940 | Hartsel . | |
| 2,273,584 | 2/1942 | Moore . | |
| 2,274,888 | 3/1942 | Coppock . | |
| 2,986,366 | 5/1961 | Wesson . | |
| 3,722,031 | 3/1973 | Bourgeois | 16/317 |
| 3,939,986 | 2/1976 | Pierro | 248/231.4 X |
| 4,023,763 | 5/1977 | Pulley . | |
| 4,090,274 | 5/1978 | Bourgeois | 16/317 |
| 4,141,524 | 2/1979 | Corvese, Jr. | 248/231.4 X |
| 4,332,364 | 6/1982 | Beskin . | |
| 4,475,705 | 10/1984 | Henneberg et al. | 248/442.2 |
| 4,582,285 | 4/1986 | Bello . | |
| 4,619,429 | 10/1986 | Mazza . | |
| 4,632,471 | 12/1986 | Visnapuu . | |
| 4,645,163 | 2/1987 | Zovar . | |
| 4,869,565 | 9/1989 | Bachman | 248/918 X |
| 4,880,300 | 11/1989 | Payner et al. . | |
| 4,902,078 | 2/1990 | Judd | 248/918 X |
| 4,913,390 | 4/1990 | Berke . | |
| 4,934,853 | 6/1990 | King, III . | |
| 4,957,261 | 9/1990 | Cirami | 248/454 |
| 4,960,257 | 10/1990 | Waters | 248/918 X |
| 4,987,690 | 1/1991 | Aaldenberg | 248/447 X |
| 5,035,392 | 7/1991 | Gross et al. | 248/918 X |
| 5,074,512 | 12/1991 | Gianforcaro, II et al. | 248/918 X |
| 5,078,358 | 1/1992 | Egly et al. | 248/918 X |
| 5,082,235 | 1/1992 | Crowther et al. | 248/231.4 X |

*Primary Examiner*—David A. Scherbel
*Assistant Examiner*—Derek J. Berger
*Attorney, Agent, or Firm*—Workman, Nydegger & Jensen

[57] ABSTRACT

The invention comprises a display mounted document holder devised to clamp to a display monitor, having a document platen on either the right side or the left side, or both sides, wherein the document platen can be positioned vertically in a plurality of positions, and wherein the document platen is normally tilted and oriented so as to substantially face the user, but is capable of being tilted in a variety of angles. The document platen may be swung from a position substantially facing a user to a position substantially facing the side of the display monitor to free valuable working space. The document platen is swung by means of a hinge located on the arm which secures the position of the document holder relative to the display monitor. The hinging action is monitored by a locking mechanism which may be operated from either the left or right sides of the display monitor. The document platen also incorporates a copy marker and a copy clamp.

44 Claims, 8 Drawing Sheets

DISPLAY MOUNTED DOUMENT HOLDER

BACKGROUND

1. The Field of the Invention

This invention is in the field of apparatus for holding documents adjacent to a display such as a computer monitor, a word processor monitor, a classroom TV display or similar device.

2. The Background Art

The recent proliferation of digital computers in modern society has greatly increased the availability of what has become known as "word processing" to large numbers of people. The widespread availability of digital computers has also benefited fields such as business, science, and industry. As the availability of digital computers has increased, so has the number of individuals who are at least somewhat proficient at entering information onto the computers, typically on a conventional "QWERTY" keyboard. Moreover, modern word processing and desktop publishing techniques have greatly increased the productivity of even experienced typists.

Both beginning and experienced typists generally have occasions where information contained in a document must be manually entered on a keyboard or viewed for comparative purposes. Moreover, as the applications of computers has expanded, users such as engineering, medical, financial, and business professionals often must view documents or three-dimensional articles while working at a display. Many such users of displays have heretofore been without a suitable apparatus for holding various papers, books, and other articles while using a display. As used herein, the term "document" is intended to include planar sheets of paper such as handwritten notes, bound sheets of paper such as a book or periodical, bulky three-dimensional objects, or other materials which are visually perceived.

In the case of a typist inputting information on a keyboard, proper typing technique requires that the typist maintain visual contact with the original document, and not with the keyboard or the typist's fingers. In order to facilitate the task of the typist, various devices often referred to as copy holders were introduced.

Copy holders in the past have generally been devices which include a base, often weighted, which are adapted for resting on the work surface (e.g. a table top or counter top) next to a typewriter. Copy holders also have generally included a flat copyboard which supports the original document and a vertical pole which holds the copyboard above the work surface. In this way the original document was held in a position which allowed the typist to more easily view the document and to change visual focus from the typed page to the original document if necessary. While previously available copy holders are an improvement over placing original documents directly on a work surface, their use entails several drawbacks and disadvantages.

Among the disadvantages of many previously available copy holders is the fact that the base of a copy holder occupies space on a work surface, even when not being used, which might be devoted to other items. Moreover, with nearly all displays used with computer systems and word processors, the display is supported a substantial distance above the work surface. Conventional copy holders, however, are designed to hold the original document near the level of a typewriter, i.e.. much lower than the level of a display. Thus, the fatigue, and the number of errors, experienced by a typist may be increased by the extra eye movement and refocusing required when switching between the original document and the text on the display when using many previously available copy holders. This is particularly true when transcribing information contained on the bottom of the original document. Still further, merely increasing the height of the copyboard of a conventional copy holder increases the ungainliness of the device and the likelihood that it will be tipped over.

Another disadvantage of many previously available copy holders is that the holders are not easily moved from an area of use to an area of non-use to free up work space. Usually copy holders are clumsy or bulky such that it takes a significant amount of time and/or energy to move the copy holders into or out of a working position. Copy holders are therefore generally either left in a non-working position and unused, left in a working position occupying valuable work space, or changed between working and nonworking positions, and thus wasting valuable working time, either scenario being counterproductive to efficient working time.

In still another example, a doctor, engineer, or technician may have a drawing, photograph, or print which is to be compared to images provided on the display. Furthermore, bookkeepers and accountants often must compare or enter numbers from a sheet of paper to a computer terminal. Heretofore, such users have not had an apparatus which would readily hold the original adjacent to the display to allow easy simultaneous side by side viewing of both the original document and the image on the display as the image was manipulated or changed.

In view of the foregoing, it would be an advance in the art to provide a document holder which is particularly adapted for use with computer system and word processor displays. It would also be an advance in the art to provide a document holder which holds various types of documents and articles at a position, and in an orientation, which is most efficient for a user viewing a terminal display. It would also be an advance in the art to provide a document holder which does not take up any work surface space and which may hold a variety of objects. It would also be an advancement in the art to provide a document holder which is adaptable for use with a variety of different sized display monitors.

OBJECTS AND BRIEF SUMMARY OF THE INVENTION

In view of the present state of the art, it is a primary object of the present invention to provide an apparatus for holding original documents in a position, and at an orientation, where they may be efficiently viewed by an individual entering information onto a computer.

It is another object of the present invention to provide an apparatus for holding an article or a document in a position which may be conveniently viewed by a user while simultaneously viewing a display.

It is still another object of the present invention to provide an apparatus for holding any one of several different types of documents at a position transversely adjacent to a computer display where it can be most efficiently viewed by a terminal operator.

It is still another object of the present invention to provide an apparatus for holding documents, or bulky three-dimensional objects, adjacent to a computer display which does not occupy any work surface space.

It is also an object of the present invention to provide an apparatus for holding documents wherein the apparatus may be quickly and easily moved into or out of a position transversely adjacent to a computer display such that the area transversely adjacent to the computer display is unoccupied.

It is a still further object of the present invention to provide an apparatus for holding a document in a position conveniently viewable by a typist using a computer display which may be easily adapted to hold a document on the left or the right of the display, or a document on each side of the display, and which may be readily interchanged from one display to another display of different dimensions without requiring any modifications to the displays.

Additional objects and advantages of the present invention will be apparent from the description and claims which follow, or may be learned by the practice of the invention.

Briefly summarized, the foregoing objects and advantages are realized in an improved apparatus for holding documents such as papers, books, and other articles while a user views both document and a display such as is associated with a digital computer. In each of the presently preferred embodiments described herein, the apparatus is attached by a clamping structure to a display. Documents are placed on the apparatus which then holds the documents above the work surface in an optimum position for viewing by the user.

In the described embodiments, the clamping structure grips the exterior housing of the display, interfacing the top and sides of the display at a position relatively near the front of the display. The copy holder is attached to the clamping structures by a holding arm which is so devised as to hold the bottom of the copy holder oriented substantially parallel to the work surface, with the plane of the copy tilted upwards and facing towards the viewer, thus providing most convenient viewing.

The tilting of the plane of the copy upwards is adjustable due to the placement of a variable slotted receiver attached to the rear of the copy holder. The variable slotted receiver includes a series of longitudinally parallel recessed areas that are angularly displaced to adjustably tilt the plane of the copy holder, depending on the recessed area in which the holding arm is disposed. By varying the recessed area to which the holding arm is positioned within, the angle at which the copy holder is tilted relative to the work surface can be adjusted.

Additionally, slidable engaging means are provided for positioning the copy holder vertically in a plurality of positions. The slidable engaging means include a series of recessed areas formed about the outer surface of the vertical sections of the clamping structures to which the holding arm is positioned. By varying the recessed area to which the holding arm is disposed, the angle at which the copy holder is vertically oriented relative to the work surface can be adjusted.

Additionally, the copy holder is so devised that it may be positioned on either the right side or the left side of the display. Thereafter, copy holder may be folded against the side of the computer screen to free up valuable work space. Copy holder is folded by means of a hinge placed in the holding arm. The hinge has a locking system to allow or prevent the folding action, the locking system being operable if the copy holder is positioned on either the left or right side of the display.

Finally, means for restraining the movement of the copy holder and the display are provided. Preferably, frontal restraints are provided to prevent tipping of the copy holder. In addition, restraints are provided to keep the display from moving once a weighted object is placed in association with the copyholder. A copy marker and a copy clamp are also provided.

DETAILED DESCRIPTION OF THE PREFERRED EMBODIMENTS

Figure 1:
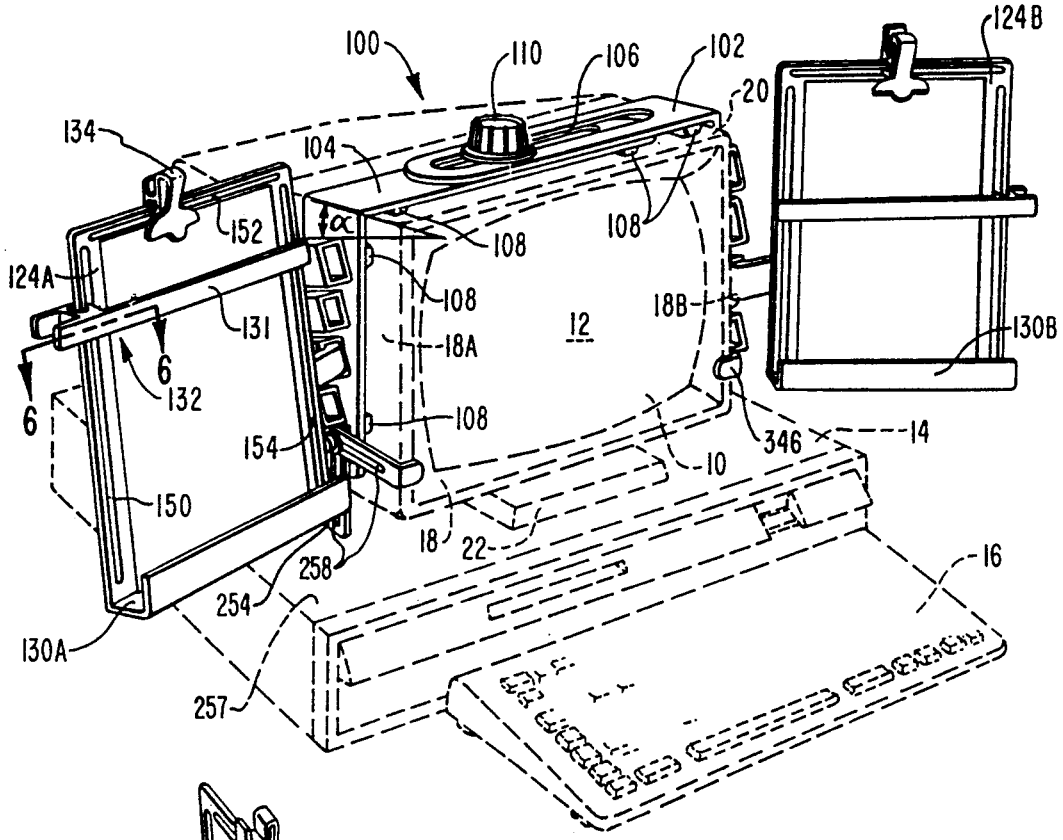
FIG. 1 is a perspective view of a presently preferred embodiment of the present invention installed on a representative computer display.

As will be appreciated by consideration of the following description as well as the accompanying drawings, the inventive concepts of the present invention may be embodied in many different forms. The presently preferred embodiment described herein represents the presently preferred best known mode for carrying out the invention. Nevertheless, many embodiments, or variations of the preferred embodiment, other than those specifically detailed herein, may be used to carry out the inventive concepts described in the claims appended hereto.

In the accompanying drawings, like structures will be provided with like reference numerals. Moreover, it will be appreciated that those having skill in the art will be able to readily substitute other structures for carrying out the same or equivalent functions as those carried out by the illustrated structures specifically described herein in order to implement the various features of the present invention.

As described earlier, the use of computer displays has become widespread in many aspects of modern society. Accompanying the increased use of computer displays, whether with dedicated word processing systems or other digital computer systems, little has been provided in the previously available art to conveniently hold documents and things in the proper position so that both the display and the documents may be simultaneously viewed and reached by an individual using a display. Thus, the present invention provides an apparatus for holding documents in a proper position transversely adjacent to a computer display which provides advantages not heretofore available in the art. As used herein, the term "display" is intended to include any device now known or developed in the future which is used to communicate alpha-numeric or graphical information from a camera or data processing device, such as a computer, to a user. Generally, the user will be a typist sitting in front of the display. However, the user may be an individual who is merely comparing an image on the display to an original document. Still further, other users may be carrying out different tasks. One example of a display currently used in the art is the conventional cathode ray tube (CRT) display illustrated in the accompanying drawings. Additionally, many other types of displays may benefit from the use of the present invention.

Often displays are self-contained in their own housings. The housings are generally elevated somewhat above the work surface upon which the keyboard of the computer rests. Such self contained displays are represented in FIGS. 1-2.

Figure 2:
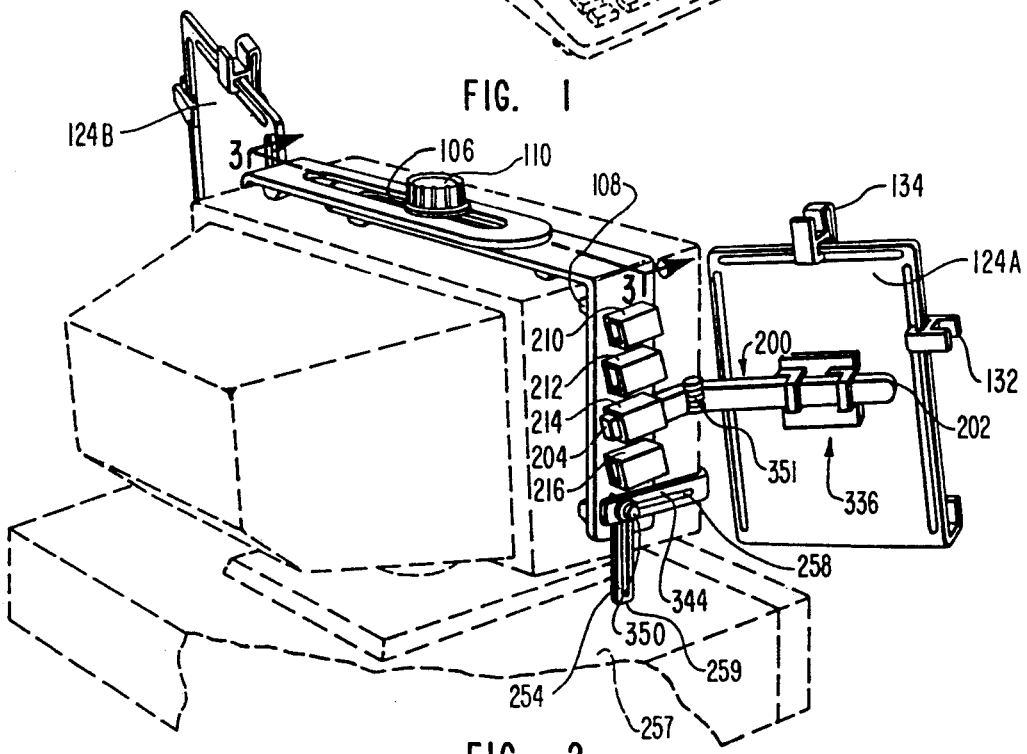
FIG. 2 is a reverse perspective view of the presently preferred embodiment installed on a representative computer display.

A presently preferred embodiment of the present invention, generally designated 100, is represented in the perspective view of FIG. 1. Represented in FIG. 1 is a computer display 10 with an associated computer CPU 14 and keyboard 16 all illustrated in phantom outline. It will be appreciated that the display 10, computer CPU 14, and keyboard 16 are merely representative of the many different equivalent structures with which the embodiments of the present invention may be used.

The display 10 includes a CRT, the face of which is shown at 12, and a housing. The housing includes substantially vertical sides 18A and 18B and a top 20. The display 10 includes a pedestal 22. As is common in the art, the pedestal 22 is adapted to allow the angle at which the display 10 is oriented to be varied in one or more planes (i.e., tilt and swivel). Moreover, the display 10 may also be set upon a shelf elevated above the work surface or placed directly upon a work surface such as a table top.

Display 10, being a CRT type of display, is also commonly referred to in the art as a "monitor." Furthermore, the combination of a keyboard, display, and computer CPU is often referred to as a "terminal" when part of a larger computer system. All of the above are capable of benefiting from the use of the present invention.

According to the broad inventive concepts of the present invention, the embodiment of the present invention includes an attaching means such as a U-shaped clamp for compressively gripping the sides and top of a display such that the positional relationship between said attaching means and the display remains fixed when force is applied to the attaching means.

As one example, and not by way of limitation, of an attaching means which may be used with the present invention, the presently preferred embodiment includes a left attachment leg 102 and a right attachment leg 104. The structure of the left and right attachment legs can be seen best in the forward and reverse perspective views of FIGS. 1 and 2, respectively, and the cross-sectional view of FIG. 3. The structure formed by the left and right attachment legs 102 and 104 may be referred to as a U-shaped clamp as may other structures performing equivalent functions. Furthermore, since the left and right attachment legs 102 and 104 grip the surface of the display, these structures may also be referred to as gripping members.

Figure 3:
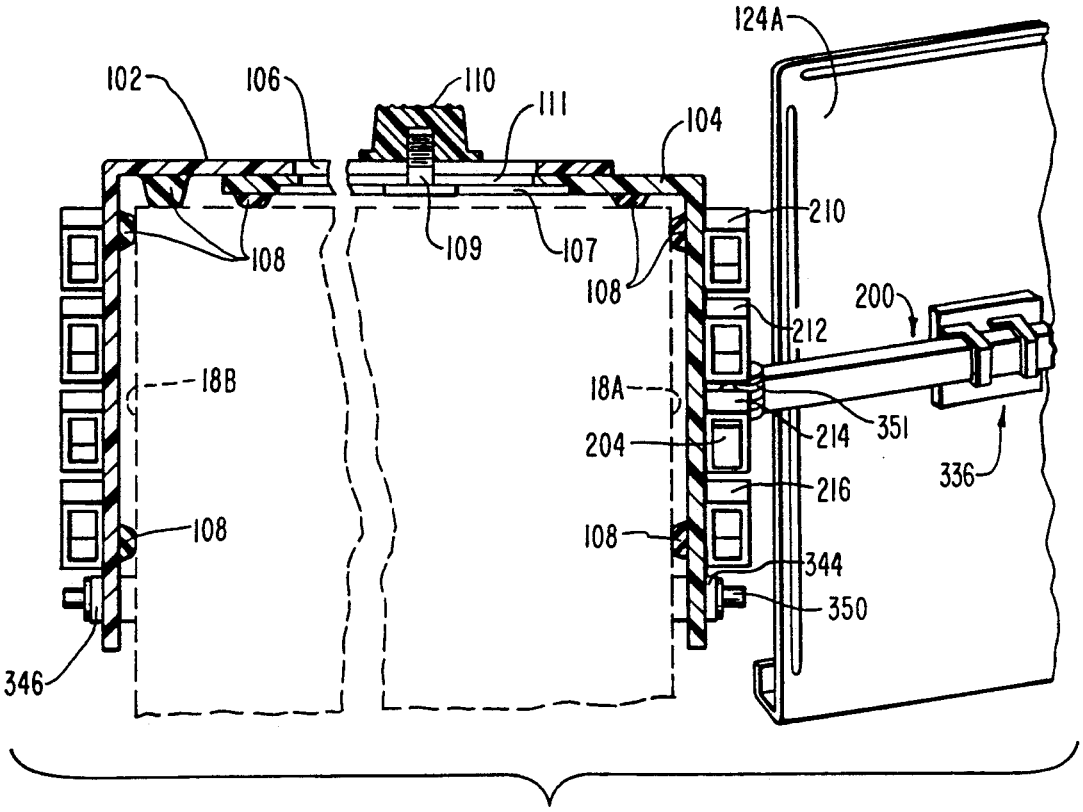
FIG. 3 is an elevated cross-sectional view of the embodiment taken along line 3—3 of FIG. 2 indicating the engagement of the left and right attachment legs.

As shown in FIGS. 1-3, the left and the right attachment legs 102 and 104 comprise members having a generally L-shaped configuration. Moreover, preferably the L-shape is such that the angle between the legs of the "L" is slightly less than 90°, preferably within the range of 80° to 90° when not assembled to the display. On the inside surface of each of the attachment legs 102 and 104 are cushions 108, spaced apart as shown best in FIGS. 1, 2 and 3. In the presently preferred embodiment, the cushions 108 comprise ridges of resilient material. When the left and right attachment legs 102 and 104 are applied to the display 10, the cushions 108 are slightly compressed and thus frictionally engage the housing of display 10 on both vertical sides 18A and 18B and at the top 20. The resultant gripping function is materially aided when the angle between the legs of the "L," when not clamping the display, is less than 90°, as noted above.

The left attachment leg and right attachment leg, 102 and 104 respectively, may be fabricated from one of many different materials known to those skilled in the art. For example, attachment legs 102 and 104 may be fabricated from a suitable plastic material as may many other structures represented in the drawings. Alternatively, materials such as metal and wood may be used to fabricate left and right attachment legs 102 and 104 as well as the other structures of the embodiment represented herein.

In the presently preferred embodiment, the attachment means further comprises a knob 110 which is shown in cross-section in FIG. 3. Knob 110, and its associated bolt 109, function to adjustably lock the left attachment leg 102 and the right attachment leg 104 in a fixed positional relationship. As can be seen in FIGS. 1, 2, and 3 the left attachment leg 102 is provided with a longitudinal slot 106 provided on the upward facing leg thereof.

Although the presently preferred embodiment of the attachment means comprises a knob, it should be understood that the present invention is not limited as such. In an additional embodiment, the attachment means comprised a wing nut (not shown). Alternatively, the present invention may comprise other attachment means similar to knob 110 or wing nut known to those skilled in the art.

As shown best in the cross-sectional view of FIG. 3, the bolt 109 is embedded in a recess 107 into right attachment leg 104 and the shaft of the bolt 109 extends up through the slot 111 provided in the right attachment leg 104 and the slot 106 provided in the left attachment leg 102. Thus, as the knob 110 is tightened onto bolt 109, the adjoining surfaces of the left attachment leg 102 and the right attachment leg 104 are pressed together to create a friction lock In this way, the spacing between the vertical portions of the attachment legs may be fixedly adjusted to accommodate displays having different dimensions. The knob 110 is preferably sufficiently large, and properly shaped, such that a user may adequately finger tighten the knob 110 to create a friction lock.

Figure 4:
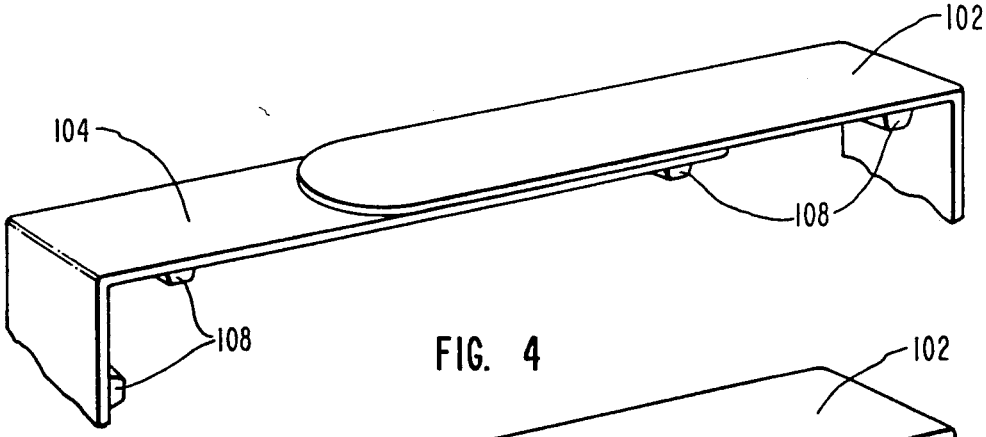
FIG. 4 is a partial perspective view of an alternate arrangement showing the attachment legs affixed to each other.
Figure 5:
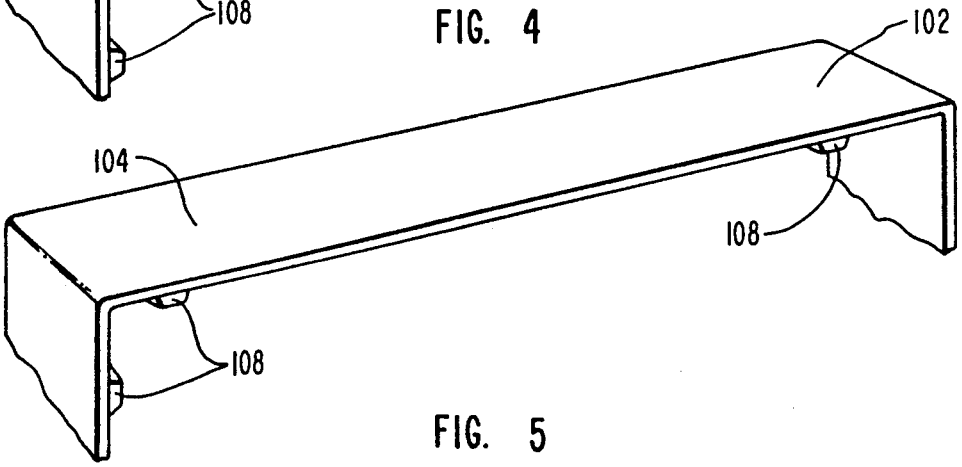
FIG. 5 is a view corresponding to FIG. 4 except showing the attachment legs fashioned as a unitary member.

The just described arrangement of bolt 109, knob 110, recess 107 and slots 106 and 111 is just one example of how a locking means of the present invention may be carried out. Alternatively, the attachment legs 102 and 104 may be affixed to each other, by cementing or other permanent means, or stuck together by the use of a plastic dual lock or VELCRO®, as shown in FIG. 4. As still another variation attachment legs 102 and 104 may be fashioned as a unitary member as shown in FIG. 5. As shown the arrangements of FIGS. 4 and 5 dispense with the necessity of providing the bolt, wing nut, recess and slots. Either of these arrangements may be utilized when the apparatus need not be adjustable to accommodate displays having different dimensions.

According to the broad inventive concepts of the present invention, a holding means for holding a document in a configuration to allow viewing of the document by a user sitting at the display is provided. By way of example and not limitation, copy platens 124A and 124B in FIGS. 1 and 2 function as a holding means.

As can be seen best in FIGS. 1 and 2, copy platens 124A and 124B are each a generally planar structure provided with a trough (generally designated 130A or 130B in FIG. 1) at its bottom. Each of the troughs 130A and 130B provides a shelf upon which a document may rest. Troughs 130A and 130B may be of various lengths and widths known to those skilled in the art to accommodate a wide variety of books and documents placed thereon.

As will be appreciated by those skilled in the art, the holding means of the present invention may comprise structures other than those specifically described herein but performing similar or equivalent functions. For example, the holding means may include only one copy platen 124A or 124B which may be disposed on either the left or the right of the display. Additionally, the trough may be configured so as to hold a book in an open position at a selected page.

Figure 6A:
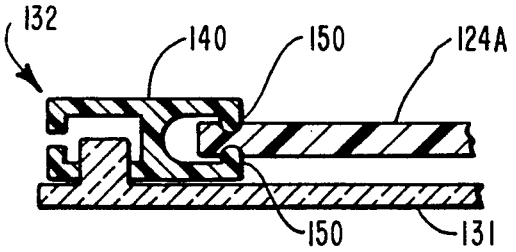
FIG. 6A is a cross-sectional view taken along the lines 6—6 of FIG. 1 in engagement with a document platen.
Figure 6B:
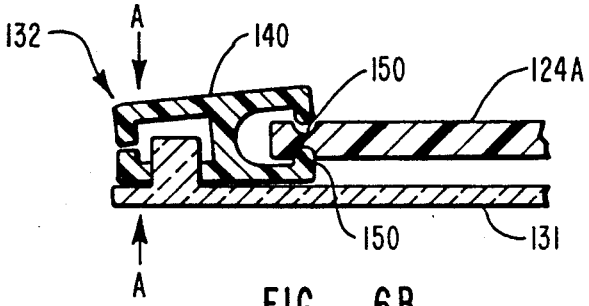
FIG. 6B is similar to FIG. 6A except with the clamp in a release position.

As can be seen best in FIG. 1, the document platen 124A may be provided with a moveable copy marker, generally designated 1 32, and a copy clamp, generally designated 134. The copy clamp 134 and the copy marker 132 are secured to the perimeter of the document platen by a structure best represented in FIGS. 6A and 6B. FIG. 6A is cross-sectional view of the copy marker 132 comprising a squeeze clamp 140 and a marker bar 131. As can be seen in FIGS. 1 and 6A–B, each side of the document platen 124A is provided with grooves 150, 152, 154 around its perimeter.

As shown in FIG. 6A, the arms of the squeeze clamp 140 rest in the grooves 150 fashioned in opposing faces of platen 124A. When pressure is applied to the squeeze clamp 140, as indicated at arrows A in FIG. 6B, the squeeze clamp arms are disengaged from grooves 150 and the marker bar 131 can be repositioned. A similar squeeze clamp structure is associated with the copy clamp 134. Providing similar grooves 150 and 154 near the right and left edges of the document platen allows the document platen to be placed on either the right or left side of the display and the document marker to engage either grooves 150 or 154 as needed.

In keeping with the broad inventive concept of the present invention, a securing means for securing the holding means to the attaching means may also be included in the presently preferred embodiment of the present invention. The securing means secures the holding means to the attaching means such that the holding means is positioned transversely adjacent to the display in a position viewable by a user of the display. Generally, the user of the display will be a typist sitting at the keyboard 16. However, a user may also be an individual viewing a display and carrying out tasks using a mouse or some other input device or perhaps even verbal commands. Still further a user may be merely viewing both an original document and the display without entering any information to the keyboard 16.

Preferably the securing means is devised such that the holding means may be positioned at a plurality of different selected vertical positions.

As shown best in FIGS. 2 and 3 the securing means comprises a securing arm generally designated at 200, the second end 202 securing arm 200 is adjustably attached to the rear side of platen 124A and the first end 204 of which functions as a slide which is slidably engaged with a slideway such as 214. Various configurations of the slideway 214 may be employed as will be discussed later. In addition, slideway 214 may be angled with respect to the line of axis of attachment legs 104 and 106, or perpendicular depending on the design choice of a manufacturer, as pictured in FIG. 12.

Securing arm 200 is preferably fashioned as a flat strip having a rectangular cross section, although other geometrical configurations could be used such as square, triangular, semicircular, elliptical, or any shape which is not circular. Whatever configuration securing arm 200 takes, slideway 214 is configured so as to have a matching contour such that first end 204 of securing arm 200 snugly, but not tightly, engages slideway 214.

Figure 7:
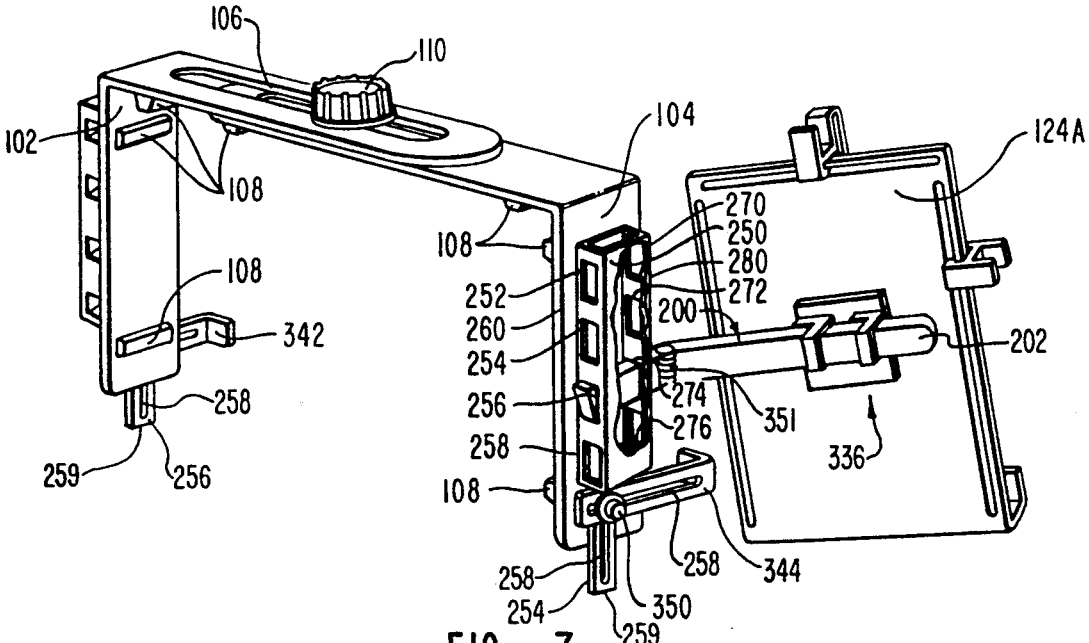
FIG. 7 is a view corresponding to FIG. 2 except showing an alternative slideway and with the display removed.
Figure 8:
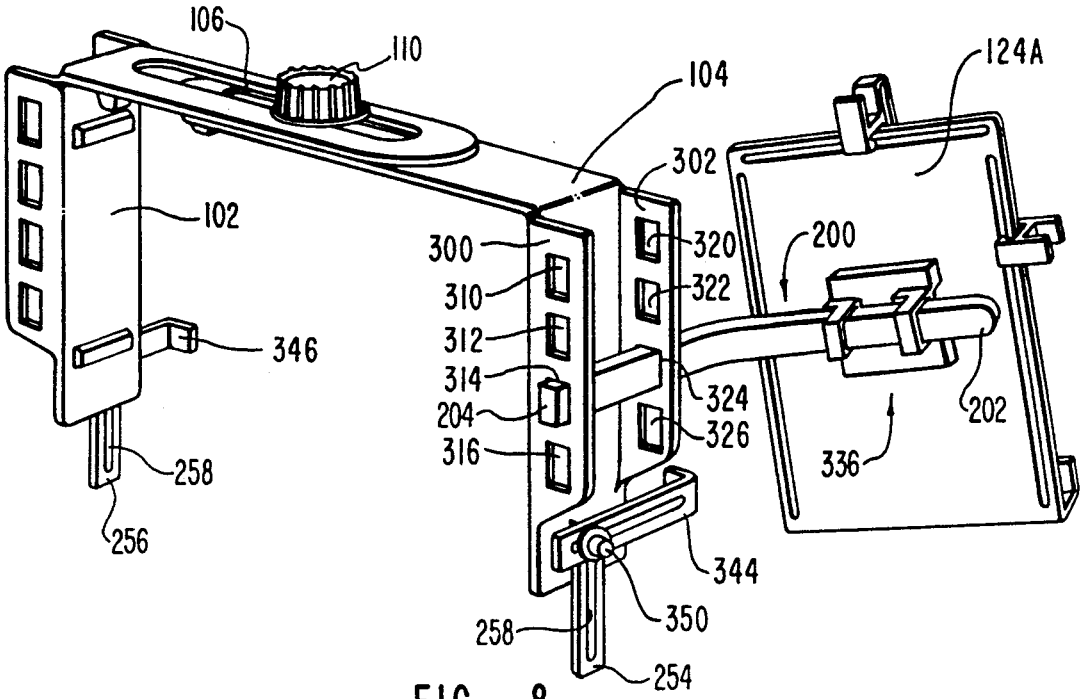
FIG. 8 is a view corresponding to FIG. 2 except showing a second alternative slideway and with the display removed.

The axis of securing arm 200 is, in one embodiment of the present invention, bent or curved as shown in FIGS. 2, 7 and 8 so as to orient the platen such that its front surface faces inwardly, thus being substantially orthogonal to the line of sight of a user sitting directly in front of the display. The bend or curve of the axis of securing arm 200 is about 45° although an angle in the range of 30° to 90° could be used if desired and still provide the desirable feature of having the document approximately face the viewer.

As noted above it is preferable to have the securing means so devised that the holding means may be adjusted vertically to a plurality of different positions. This is preferably effected in the present invention by incorporating a plurality of slideways such as 210, 212, 214, and 216 vertically displaced from each other as shown in FIGS. 2 and 3. Alternatively, a single slideway may be used and a plurality of mounting bores such as 340 in FIG. 12, or other preferable means of connection to be discussed in greater detail at a later point may be fashioned in the platen 124A.

As noted above, various alternative types of slideways may be used. One such is shown in FIG. 7. In this version a channel 250 is affixed to an attachment leg such as 104, as shown. Channel 250 has a plurality of geometrical cutouts such as 252, 254, 256 and 258 fashioned in one face 260 of the channel. Corresponding similar cutouts 270, 272, 274 and 276 are fashioned in the opposing face 280 of the channel. Cutouts 270 through 276 are displaced vertically so as to be slightly higher than corresponding opposed cutouts 252 through 258 such that a line joining the centers of a pair of corresponding opposed cutouts, such as 252 and 270, forms the desired tilt angle with respect to the attachment leg 104.

As illustrated in FIG. 7, the cutouts such as are rectangularly shaped, therefore correspondingly the holding means are rectangularly shaped to engage the cutouts. The rectangular shape is preferred since an increased amount of surface area of the holding means engages the gripping members and the amount of play experienced by the holding means and thus platen 124A in slideway 214 is reduced. Although the geometrical cutouts forming the slideways are preferably rectangular, as shown, they may be square, triangular, semicircular, elliptical or something other than circular so as to prohibit undesired rotation of securing arm 200.

A still different alternative type of slideway is shown in FIG. 8. In this version the slideway is fashioned as a part of bent-out portions 300 and 302 of attachment leg 104. Geometrical cutouts 310, 312, 314, 316 are formed in bent-out portion 300 and similar corresponding cutouts 320, 322, 324, 326 are formed in bent-out portion 302. Cutouts 320– 326 are displaced slightly higher than cutouts 310–316 such that a line joining the center of corresponding cutouts, such as 310 and 320, forms the desired tilt angle with respect to attachment leg 104. The geometrical cutouts are preferably flat-shaped and rectangular, as shown, although they may be square, triangular, semicircular, elliptical, or something other than circular so as to prohibit undesired rotation of securing arm 200.

It is also preferable to have the document platen tilt upwardly since a user's eyes are usually at a higher elevation than the display. This feature is effected in the present invention by having the axis of the slideway point downwards from front to back as shown in FIGS. 1 and 2. A preferable angle of tilt is approximately 30° although any angle within the range of about 15° to 45° could be used and still accomplish the desired result of having the document approximately face the viewer. This is effected in the present invention by positioning the slideway such that its axis forms an angle $\alpha$ as shown in FIG. 1, equal to the desired tilt angle.

Additionally, the holding means is preferably devised such that the document platen adjustably tilts upwardly and faces inwardly, within ranges as described below, so as to cause the document to substantially face the eyes of a variety of viewers sitting directly in front of the display. The means for adjusting platen 124A tilt is effectuated in the present invention by incorporating a plurality of recessed areas such as 330 and 332 in FIG. 9 into which securing arm 200 may be positioned. The angle of platen 124A is varied depending on the recessed area securing arm 200 is positioned.

Preferably, securing arm 200 is slidably attached to platen 124A by means of a variable slotted receiver 336 (see FIGS. 2, 8, 9 and 10) which is attached to the rear of platen 124A by molding, adhesion or other means known to one skilled in the art. Receiver, designated generally as 336 includes the plurality of recessed areas 330 and 332, longitudinally parallel, but angularly displaced from one another which accepts securing arm 200. By varying the recessed area to which securing arm 200 is positioned within, the angle at which platen 124A is tilted relative to the work surface can be adjusted.

Figure 9:
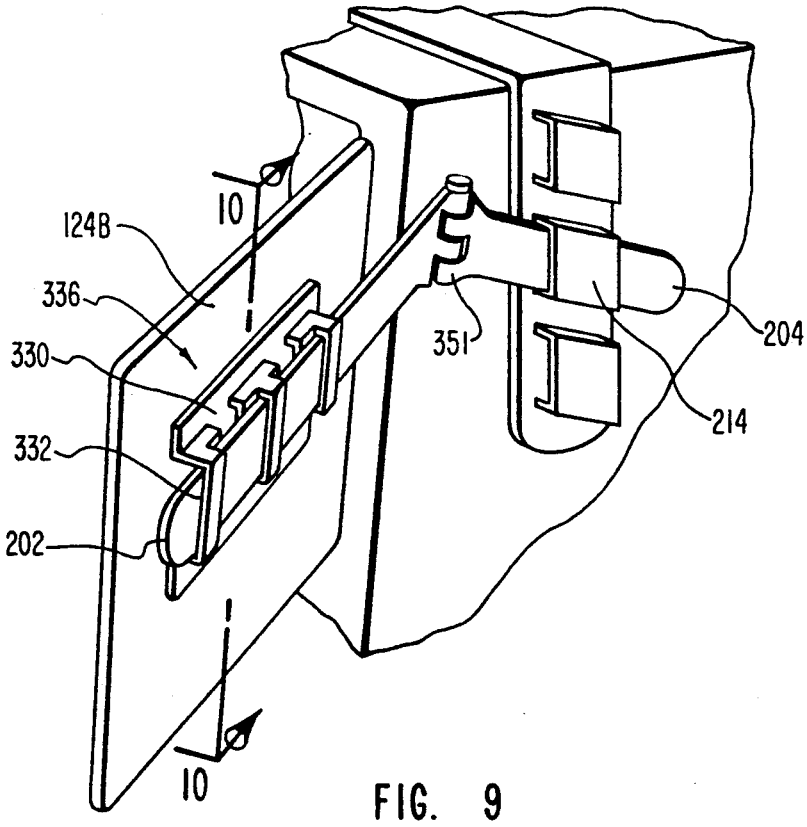
FIG. 9 is a perspective view of the variable slotted receiver.
Figure 10:
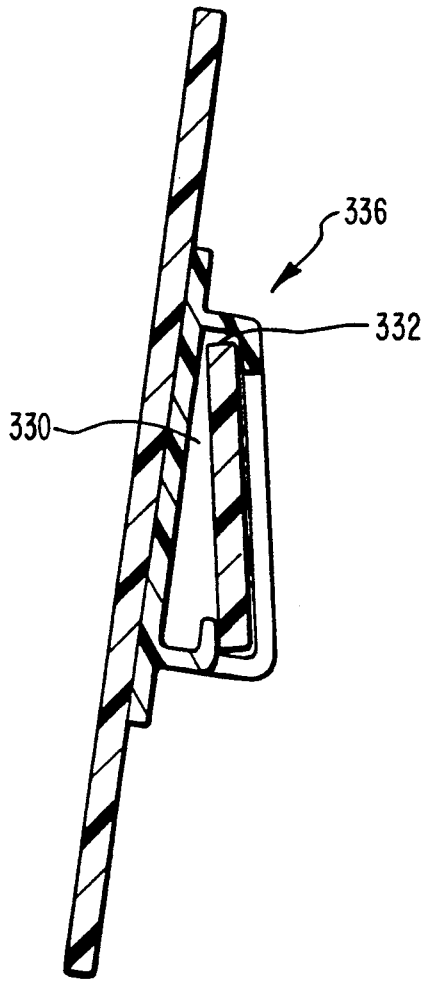
FIG. 10 is a cross-sectional of the view of the variable slotted receiver taken along lines 10—10 of FIG. 9.

The tilting action on platen 124A by receiver 336 can be understood to a greater degree by examination of FIG. 9 and FIG. 10 which is a cross-sectional view taken along line 10—10 of FIG. 9. In FIG. 9, second end 202 of securing arm 200 is placed within recess 330 of receiver 336, platen 124A has a predetermined degree of tilt, roughly about 10°. In FIG. 10, second end 202 of securing arm 200 is placed within recess 332, platen 124A has an alternate degree of tilt, roughly about 45°. It can be understood that varying the degree of angular displacement between the plurality of recesses formed in receiver 336, the degree of tilt experienced by platen 124A is varied, generally the angular displacement between each of the plurality of recesses being in the range from about 0° to about 90°.

Note that the horizontal orientation of platen 124A may be effected by increasing or decreasing the length of securing arm 200 slidably engaging recessed areas 330 and 332. Also note that this orientation may be effected for platens on either the right side or the left side.

It should also be noted that a plurality of variable slotted receivers 336 (not shown) could be vertically placed on the rear of platen 124A. More than one variable slotted receiver 336 could provide an alternative to the use of more than one slideway into which second end 202 of securing arm 200 is placed for vertical displacement of platen 124A. The plurality of variable slotted receivers 336 would enable both adjustable tilting of and vertical displacement of platen 124A.

Figure 11:
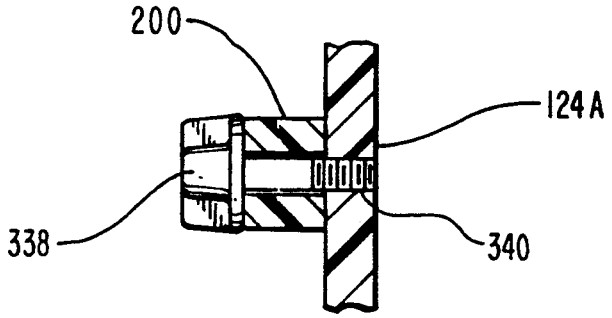
FIG. 11 is a cross-sectional view taken along lines 11-11 of FIG. 12.

It is important to note that securing arm 200 has a flat surface which interfaces platen 124A in order to prevent undesirable tilting of platen 124A. 21 It should be noted that securing arm 200 may also be attached to platen 124A by means of a screw 338 (see FIGS. 11 and 12) which extends through a hole near the second end 202 of securing arm 200 and threadedly engages a threaded bore 340 in the rear side of platen 124A. Screw 338 has a wing head such that a user may tighter screw 338 with his fingers. Thus when screw 338 is loosened, platen 124A may be rotated until its bottom and top platen 124A may be rotated until its bottom and top edges are horizontal (e.g., level) and screw 338 then tightened so as to prevent inadvertent rotation.

Figure 12:
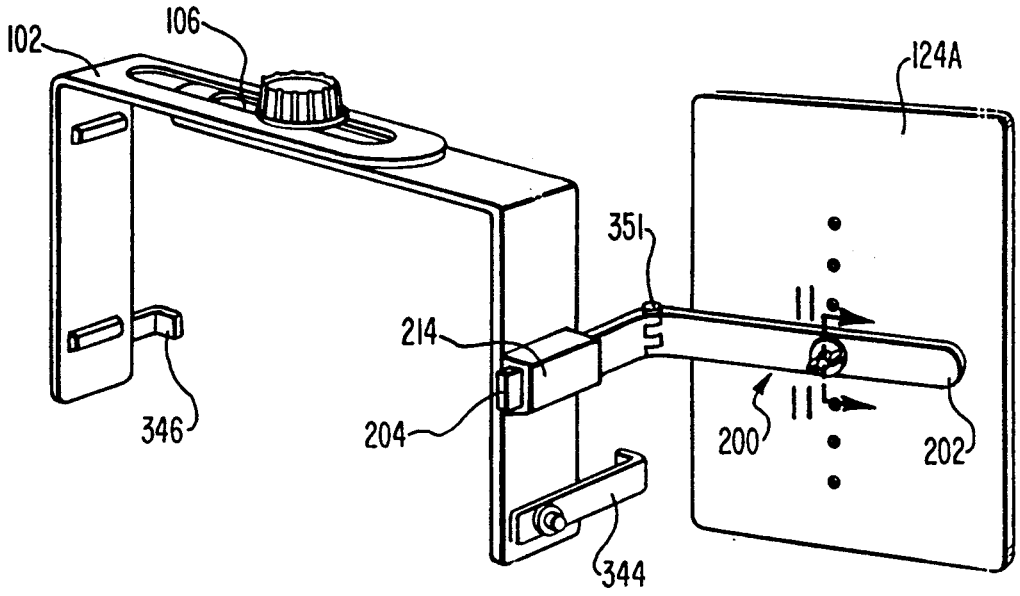
FIG. 12 is a view corresponding to FIG. 2 except showing a single slideway and with the display removed.

As mentioned earlier, a plurality of horizontally or vertically spaced bores 340 can be formed in the rear of platen 124A to provide for vertical or horizontal adjustment of platen 124A with respect to securing arm 200 as shown in FIG. 12 (or, alternatively, a plurality of receivers 336). In this embodiment, one slideway 214 may be present to engage the second end 202 of securing arm 200, and vertical and horizontal adjustment of platen 124A is maintained. By simply relocating screw 338 from a first position to an alternate position to attach platen 124A to securing arm 200, platen 124A is horizontally and/or vertically adjusted.

Although the use of receiver 336 and screw 338 and bore 340 have been discussed as a means to connect second end 202 of securing arm 200 to platen 124A, it should be understood that other means of connecting are known to those skilled in the art and are included herein. The foregoing specific means to connect have merely been provided as examples and the described embodiments are to be considered in all respects only as illustrative and not restrictive.

As a still further feature of another embodiment of the present invention, means for restraining the movement of platen 124A are provided. In the preferred embodiment, the restraining means comprises restraint arms 344 and 346, as shown in FIGS. 1, 2, and 8. These restraint arms are preferably L-shaped elongate members. Restraint arm 344 is slotted and affixed to attachment leg 104 by any suitable means such as a screw 350, as shown. Likewise, restraint arm 346 is affixed to attachment leg 106. In use, inward turning portions of restraint arms 344 and 346 bear against the front face of the display as best shown in FIG. 1, thus inhibiting undesired twisting or turning of the document-holding apparatus.

In the preferred embodiment of the present invention, the restraining means also comprises a plurality of restraint arms to perform the additional function of restraining the movement of display 10. Normally display 10 resides on an adjustable pedestal which may tilt back and forth upon the application of a weighted force. If a heavy document is placed on platen 124A, the weight of the document may tilt the display 10 since platen 124A is secured to the display 10. It can be understood that most computer operators would prefer to have some type of means to restrain the movement of display 10.

As an example, not meant to limit the scope of the present invention, slotted restraint arms 254 and 256 are affixed respectively to attachment leg 104 and 106 by any suitable means such as a screw 350, as shown in FIGS. 1 and 2. By extending restraint arms 254 and 256 from attachment legs 104 and 106 to the surface 257 of a computer CPU 14, the display 10 is prevented from tilting forward when a heavy document is placed on platen 124A. It can be understood that restraint arms 254 and 256 are slotted 258 to allow one to adjust the position of the bottom 259 of restraint arms 254 and 256 with regard to surface 257 of computer CPU 14. Use of the slot 258 allows restraint arms 254 and 256 to restrain the position of display 10, throughout a large degree of tilting action, with regard to computer CPU 14.

Figure 16:
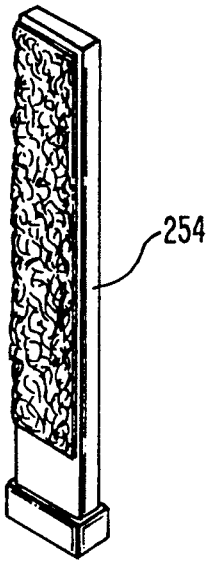
FIG. 16 is an exploded view of an alternate restraint arm to secure the position of the display, the restraint arm employing VELCRO®.
Figure 18:
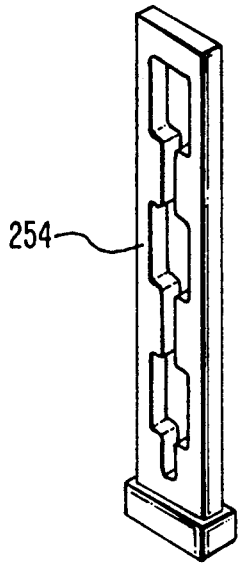
FIG. 18 is an exploded view of an alternate restraint arm to secure the position of the display, the restraint arm having multiple variably-sized apertures.
Figure 17:
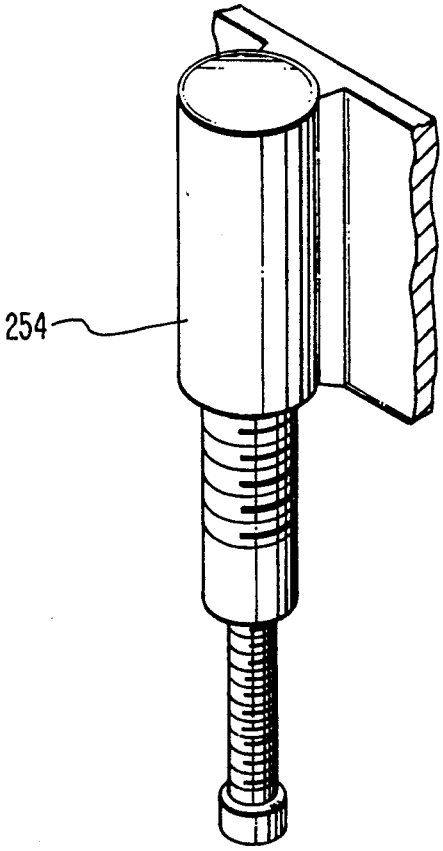
FIG. 17 is an exploded view of an alternate restraint arm to secure the position of the display, the restraint arm being telescopically adjusted in height.

Whereas restraint arms 254 and 256 are one example of means for restraining the position of display, it should be understood that the present invention is not limited as such. Additional restraint means, similar to the slotted restrain arms 254 and 256, known to those of ordinary skill in the art, can be employed. Additional restraint means include the use of a rigid member joined to a VELCRO® surface which is attached to attachment legs 104 and 106, as shown in FIG. 16, or a rigid member whose length may be adjusted to a fixed position (such as a rigid member telescopically fit within another rigid member which may be adjustable in length, but selectively fixed at any one position), as shown in FIG. 17; or a restraint arm having variable dimensioned slots, as shown in FIG. 18.

As still another preferred feature of the present invention, means for moving platen 124A into and/or out of an orientation to allow viewing of a document is provided. The means for moving are effectuated in the present invention by incorporating a hinge such as 351 in FIG. 2 into securing arm 200. By acting upon hinge 351, platen 124A may be folded against or away from the sides of the U-shaped clamp and the monitor.

More specifically, platen 124A is positioned in a plane relative to the user in an operative mode as shown in FIG. 2. When platen 124A is not being used, this position consumes a valuable area of working space. Thus, it would be preferred if platen 124A could be moved out of this position into a position which would not consume valuable working space area.

Figure 13:
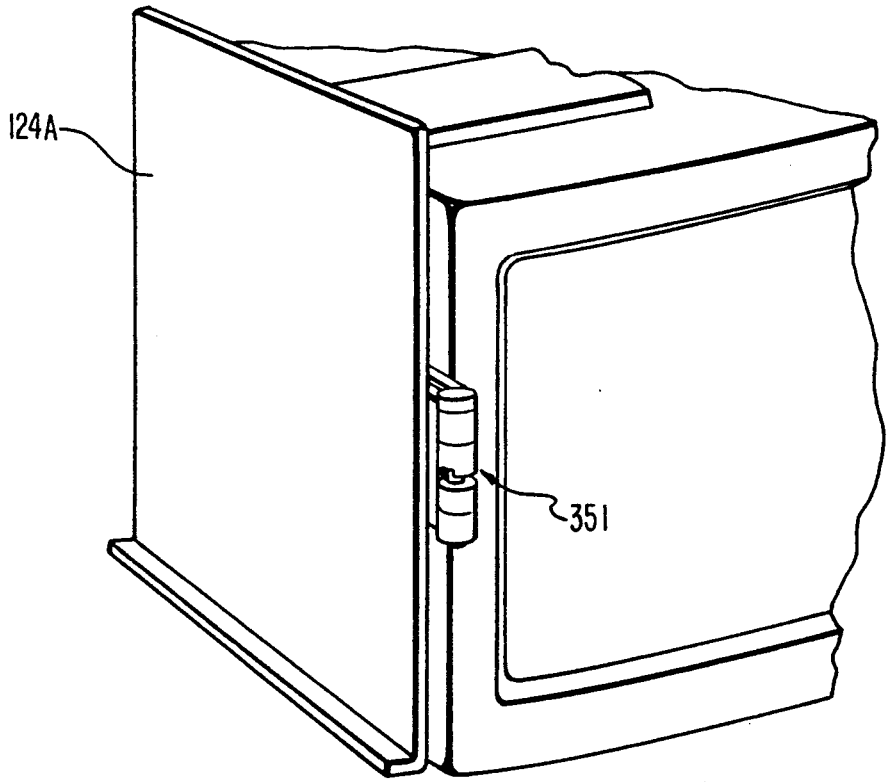
FIG. 13 is a perspective view of the document holder swung out of the working space alongside the U-shaped clamp.

As shown in FIG. 13, platen 124A can be swung aside after use into a position substantially planar with the side of the U-shaped clamp or the monitor. Platen 124A is swung aside by action upon hinge 351 of securing arm 200. In this latter position, platen 124A is out of the working space of a user until such time as platen 124A's use is required.

As an additional feature, hinge 351 is comprised of a means for locking which prevents any unnecessary action by hinge 351, thereby accidentally displacing or swinging platen 124A out of a position designated by a user. Imagine the unfriendly use of platen 124A if while during its use, platen 124A should begin to sway back and forth. Such a situation would cause both eye strain and an uneven temper.

Figure 14:
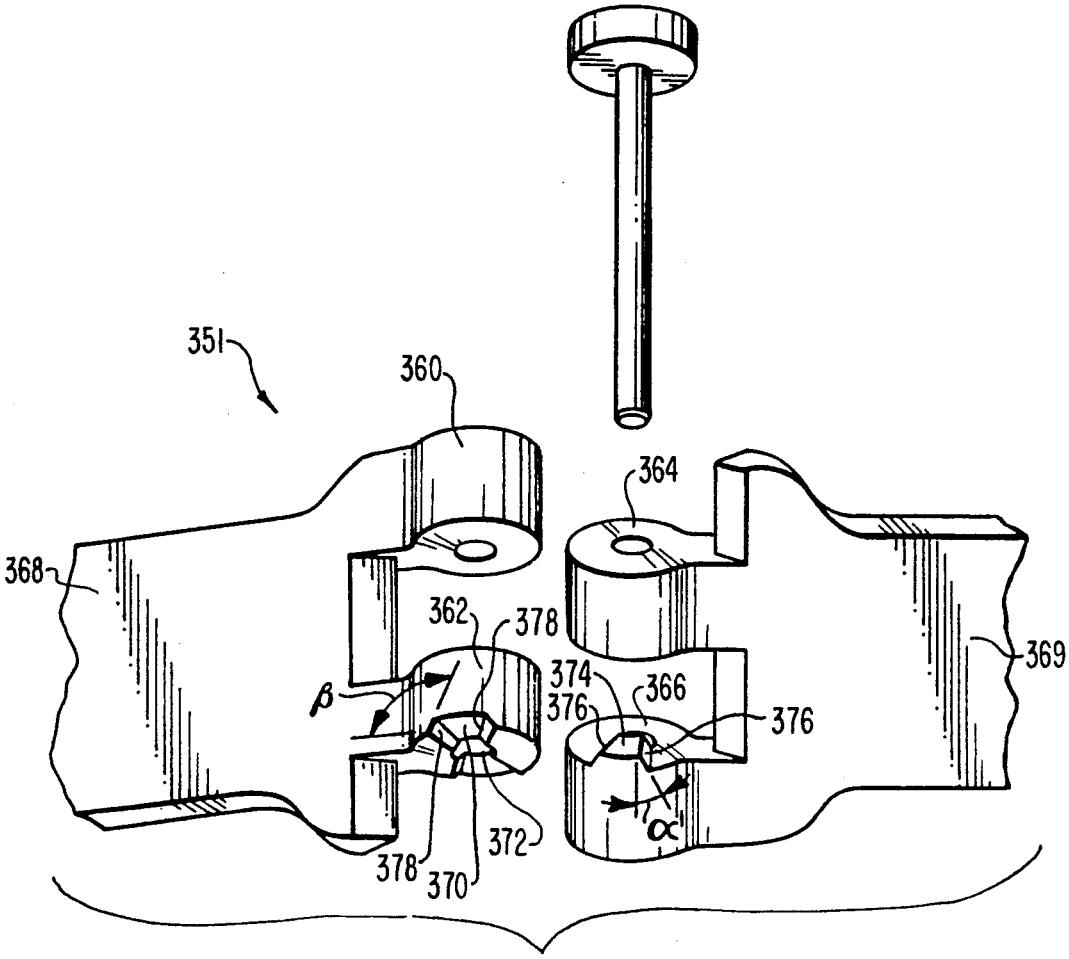
FIG. 14 is an exploded view of the hinge in a disassembled condition.
Figure 15:
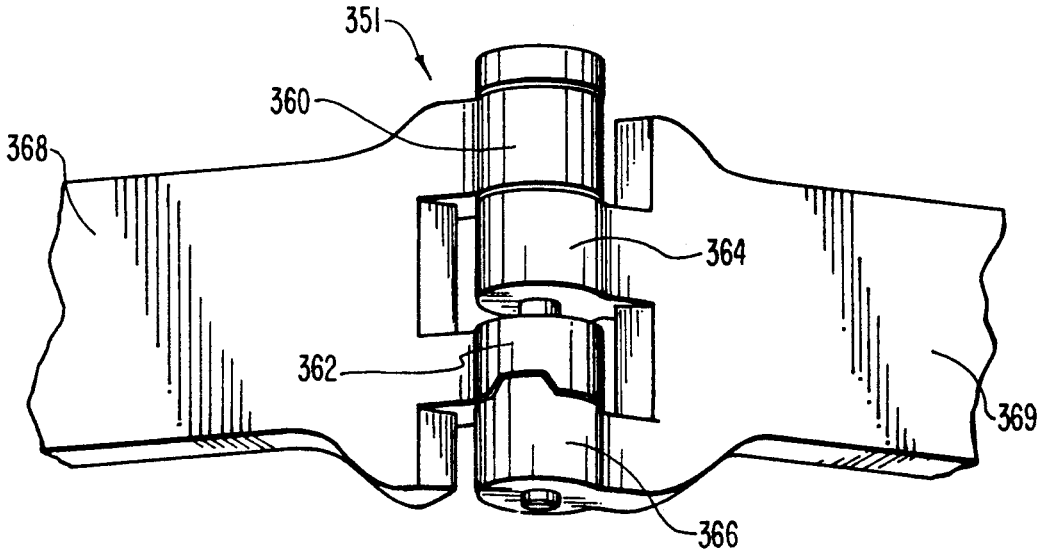
FIG. 15 is an exploded view of the hinge in an assembled condition.

The locking means can be performed by a variety of structures known to those skilled in the art to accommodate locking. As an example, not meant to limit the scope of the present invention in FIG. 14, hinge 351 is comprised of alternating channel sections 360, 362, 364, and 366. Two channel sections 360 and 362 are formed from a first section 368 of securing arm 200, and two additional channel sections 364 and 366 are formed from a second section 369 of securing arm 200. The channel sections alternating with respect to each other such that the channel sections from each portion of securing arm 200 may intertwine and engage such that a piston may be placed therethrough the formed channel and connect each portion of securing arm 200 to each other as shown in FIG. 15.

To effect the lock, at least one of each of the channel sections from each securing arm 200, which are side by side, are configured to lock onto one another. As shown in FIG. 14, channel section 362 has two indented areas 370 and 372. Correspondingly, channel section 366 has a raised appendage 374 which can engage either indented area 370 or 372.

It can be understood that hinge 351 will remain locked while raised appendage 374 engages either indented areas 370 or 372. Raised appendage 374 will not disengage indented area 370 or 372 since the force of documents on platen 124A of securing arm 200 will force the engagement of raised appendage 374 to indented areas 370 or 372. Should the pressure be overcome, channel sections 360 and 362 will rotate about a longitudinal axis with respect to channel sections 364 and 366. This rotation will cause platen 124A to swing about hinge 351.

It should be understood that disengagement of raised appendage 374 from indented areas 370 or 372 is aided by adjusting the angle of the sides 376 of raised appendage 374 to match the sides 378 of indented areas 370 or 372. The angle allows raised appendage 374 to ride out of indented areas 370 or 372. The angle allows raised appendage 374 to ride out of indented areas 370 or 372. As shown in FIGS. 14 and 15, sides 376 of appendage 374 are formed at an angle $\alpha'$ in the range from about 0° to about 20°, with respect to the line of axis the hinge revolves about. Correspondingly, sides 378 of indented areas 370 or 372 extend at angle $\beta$, in the range from about 90° to about 110°.

Channel section 362 is provided with two indented areas since platen 124A may be adjusted to be positioned from either the left or right of the monitor. If securing arm 200 is placed to the left side of monitor, securing arm 200 will swing such that when disengaged from indented area 370, securing arm 200 will rotate clockwise. If securing arm 200 is placed to the right side of monitor, securing arm 200 will swing such that when disengaged from indented area 372, securing arm 200 will rotate counterclockwise.

It can be understood that an additional lock similar to the lock located between channel sections 362 and 366 could be placed between channel sections 360 and 364 (not shown). Such an additional lock would increase the amount of force required to dislocate the amount of force required to dislocate any raised appendages from any indented areas.

From the foregoing, it will be appreciated that the present invention provides an apparatus for holding original documents in a position, and at an orientation, where they may be efficiently viewed by a typist entering information at a computer terminal keyboard.

It will also be appreciated that the present invention provides an apparatus for holding an article or a document in a position which may be conveniently viewed by a user while simultaneously viewing a display.

Additionally, the present invention provides an apparatus for holding any one of several different types of documents at a position transversely adjacent to a computer display where it can be most efficiently viewed by a terminal operator.

The present invention further provides an apparatus for holding documents, or bulky three-dimensional objects, adjacent to a computer display which does not occupy any work surface space.

The present invention still further provides an apparatus for holding documents wherein the apparatus may be quickly and easily moved into or out of a position transversely adjacent to a computer display such that the area transversely adjacent to the computer display is unoccupied.

It will further be appreciated that the present invention provides an apparatus for holding a document in a position conveniently viewable by a typist using a computer display which may be easily adapted to hold a document on the left or the right of the display, or a document on each side of the display, and which may be readily interchanged from one display to another display of different dimensions without requiring any modifications to the displays.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for holding a document adjacent to a display, said display having a substantially horizontal to surface, first and second substantially horizontal top surface, first and second substantially vertical sides, and a front display surface, comprising:

U-shaped attaching means for compressively clamping and gripping the top surface and the vertical sides of said display such that the positional relationship between said attaching means and said display remains fixed when force is applied thereto;

holding means for holding a document in an orientation to allow viewing of said document;

securing means for securing said holding means to said attaching means such that said holding means is positioned adjacent to the display in a position such that said document is viewable by a user of the display, said securing means comprising a sliding member attachable to said holding means; and a plurality of substantially parallel slideway means integral with the attaching means for cooperatively engaging the sliding member of the securing means in such way that horizontal adjustment of the sliding member within the sliding means is enabled, thereby allowing horizontal adjustment of the holding means such that the holding mean may be moved closer to or further away from the user along one plane as desired, and allowing adjustment of the height of the holding means wherein the plurality of slideway means are positioned substantially vertically with respect to each other.

2. An apparatus for holding a document as defined in claim 1 wherein the attaching means comprises:

a first attachment leg;

a second attachment leg; and means for affixing the first and the second attachment legs together.

3. An apparatus as defined in claim 2 further comprising restraint means for inhibiting relative twisting motion between said apparatus and the display as force is applied to said apparatus.

4. An apparatus as defined in claim 3 wherein said restraint means comprises a restraint arm affixed to the first attachment leg and a second restraint arm affixed to the second attachment leg, said restraint arms being adapted and positioned so as to have a portion which extends at least partially over the front display surface, and to interface said surface when said apparatus is assembled to said display.

5. An apparatus for holding a document as defined in claim 2 wherein the first and second attachment legs each comprise a first portion adapted to interface a vertical side of the display and a second portion disposed at an angle within the range of about 80° to 90° with respect to the first portion and adapted to interface the top surface of said display.

6. An apparatus as defined in claim 5 wherein the second portion of the first attachment leg and the second portion of the second attachment leg comprise connecting means for connecting the first and the second attachment legs together in one of a plurality of positional relationships with respect to each other.

7. An apparatus for holding a document as defined in claim 6 wherein the connecting means comprises:

a longitudinal slot formed along the second portion of the first attachment leg;

a longitudinal recess and a longitudinal slot formed along the second portion of the second attachment leg;

a bolt in contact with the second attachment leg, the head of said bolt being positioned in said longitudinal recess and the shank of said bolt extending through said longitudinal slots; and a nut threadably engaged to the bolt such that as the nut is tightened the first attachment leg and the second attachment leg are frictionally connected together in a fixed relationship.

8. An apparatus as defined in claim 5 wherein the second portion of the first attachment leg and the second portion of the second attachment leg from a permanent integral relationship with each other.

9. An apparatus as defined in claim 5 wherein the slideway means of the attaching means comprises slideways affixed to the first portion of one or both of the attachment legs.

10. An apparatus as defined in claim 9 wherein the slideways are positioned so as to form an angle with an axis orthogonal to the longitudinal axis of the attachment leg wherein the angle is in the range of 0° to 45°.

11. An apparatus as defined in claim 10 wherein the slideways comprise channel members fixedly attached to an attachment leg wherein the channel members have a non-circular cross section and are positioned so as to be transverse to the attachment leg.

12. An apparatus as defined in claim 10 wherein the slideways comprise pairs of matching geometrical cutouts having a non-circular cross section and which are fashioned in opposing sides of a channel member which is fixedly attached to an attachment leg.

13. An apparatus as defined in claim 12 wherein the corresponding matching geometrical cutouts of each pair are offset in a vertical direction from each other.

14. An apparatus as defined in claim 10 wherein the slideways comprise pairs of matching geometrical cutouts having a non-circular cross section and which are fashioned in opposing bent-out portions of an attachment leg.

15. An apparatus as defined in claim 14 wherein the corresponding matching geometrical cutouts of each pair are offset in a vertical direction from each other.

16. An apparatus for holding a document as defined in claim 2 wherein the first and second attachment legs include gripping members adapted to frictionally engage the top surface and the sides of the display.

17. An apparatus for holding a document as defined in claim 16 wherein the first and second attachment legs comprise resilient ridges positioned on one side of the attachment legs.

18. An apparatus for holding a document as defined in claim 1 wherein the securing means comprises:

at least one securing arm having first and second ends and wherein said first end functions as the sliding member;

first means for removably, but snugly, engaging the first end of the securing arm with the slideway means of the attaching means; and second means for securing the second end of the securing arm to the holding means.

19. An apparatus for holding a document as defined in claim 18 wherein the first means comprises a geometrical cross-sectional configuration of at least the first end of the securing arm which approximately matches the cross-sectional contour of the slideway means of the attaching means.

20. An apparatus for holding a document as defined in claim 18 wherein the second means comprises:

a mounting hole passing through the second end of the securing arm, said mounting hole being adapted to receive a screw passing therethrough; and an adjusting screw adapted to pass through said mounting hole, adapted to engage a corresponding threaded hole in the holding means, and to firmly secure said second end of said securing arm to said holding means.

21. An apparatus for holding a document as defined in claim 18 wherein the securing arm is an elongate member having a non-linear axis.

22. An apparatus for holding a document as defined in claim 21 wherein the non-linear axis curves or bends through an angle within the range of 30° to 90°.

23. An apparatus for holding a document as defined in claim 21 wherein the securing arm has a substantially flat surface adapted to interface with the holding means.

24. An apparatus for holding a document as defined in claim 1 wherein the holding means comprises a document platen.

25. An apparatus for holding a document as defined in claim 1 wherein the holding means comprises a flat planar member having a front side and an opposing rear side, further comprising a trough on the front side, said trough being adapted for supporting at least one document.

26. An apparatus for holding a document as defined in claim 25 wherein the holding means comprises further a copy marker.

27. An apparatus for holding a document as defined in claim 26 wherein the holding means further comprises grooves placed on the opposing front and rear sides of the holding means and wherein the copy marker comprises a squeeze clamp, said squeeze clamp comprising two arms, each of said arms being adapted to engage one of said grooves.

28. An apparatus for holding a document as defined in claim 27 wherein the holding means has a substantially rectangular configuration having a left edge, a right edge, a top edge, and a bottom edge, and wherein the grooves adapted to engage the two arms of the copy marker squeeze clamp comprise a pair of grooves on opposing front and rear sides of the holding means positioned substantially parallel to, and near, said left edge, and another similar pair of grooves positioned substantially parallel to, and near, said right edge, configured and positioned such that said copy marker may engage either of said pairs of grooves.

29. An apparatus for holding a document as defined in claim 26 wherein the copy marker comprises a marker bar.

30. An apparatus for holding a document as defined in claim 25 wherein the holding means further comprises a copy clamp.

31. An apparatus for holding a document as defined in claim 30 wherein the holding means further comprises grooves placed on the opposing front and rear sides of the holding means and wherein the copy clamp comprises a squeeze clamp, said squeeze clamp comprising two arms, each of said arms being adapted to engage one of said grooves.

32. An apparatus for holding a document as defined in claim 25 wherein the holding means is adapted to be placed in a substantially horizontal, (i.e., level) configuration by means of a single adjustment.

33. An apparatus for holding a document as defined in claim 32 wherein the rear side of the holding means comprises one or more threaded bores adapted to receive a screw for affixing the securing means to said holding means.

34. An apparatus for holding a document as defined in claim 1 wherein the holding means comprises a first holding means for holding at least a first document and a second holding means for holding at least a second document and wherein the securing means comprises a first securing means for securing the first holding means to the attaching means and a second securing means for securing the second holding means to the attaching means.

35. An apparatus for holding a document as defined in claim 1, further comprising means for moving the holding means between a position substantially facing a user to a position substantially facing the side of the display.

36. An apparatus for holding a document as defined in claim 35, wherein the moving means comprises a hinge.

37. An apparatus for holding a document as defined in claim 36, wherein the hinge further comprises means for locking in place the position of the holding means such that the holding means will not randomly swing between a position substantially facing a user and a position substantially facing the side of the display.

38. An apparatus for holding a document as defined in claim 37, wherein the locking means comprises an appendage on the hinge which fits an indented area on the hinge, the hinge being inoperable while the appendage engages the indented area.

39. An apparatus for holding a document as defined in claim 38, wherein the hinge operates when a sufficient amount of force disengages the appendage from the indented area.

40. An apparatus for holding a document as defined in claim 37, wherein the locking means can be employed on the hinge from more than one direction.

41. An apparatus for holding a document as defined in claim 40, wherein the hinge has two indented sections such that the appendage will engage and lock into the first indented area when the hinge is moving clockwise, and the appendage will engage and lock into the second indented area when the hinge is moving counterclockwise.

42. An apparatus for holding a document as defined in claim 1, further comprising means for adjusting the tilt of the holding means with respect to the user of the display, the tilting means being attached to the holding means.

43. An apparatus for holding a document as defined in claim 42, wherein the tilting means comprises an variable slotted receiver to which the securing means are slidably engaged.

44. An apparatus for holding a document as defined in claim 43, wherein the variable slotted receiver comprises a plurality of recessed areas into which the securing means are slidably engaged, the recessed areas being angularly displaced from one another such that the tilt of the holding means is varied depending on which recessed area the securing means slidably engages.

* * * * *